United States Patent [19]

Katayama et al.

[11] 4,441,417

[45] Apr. 10, 1984

[54] PRESSURE FIXING DEVICE

[75] Inventors: Masahiro Katayama, Kawasaki; Nobutoshi Yoshida, Yokohama; Tsukasa Kuge, Tokyo, all of Japan

[73] Assignee: Canon Kabushiki Kaisha, Tokyo, Japan

[21] Appl. No.: 315,517

[22] Filed: Oct. 27, 1981

[30] Foreign Application Priority Data

Oct. 30, 1980 [JP] Japan ..... 55-155350[U]

[51] Int. Cl.[3] ..... B30B 3/04

[52] U.S. Cl. ..... 100/176; 29/121.8; 29/132; 355/3 FU; 427/194; 430/98; 118/116

[58] Field of Search ..... 100/93 RP, 176; 29/121.8, 132; 355/3 FU; 428/906, 447; 118/60, 114, 116; 427/194; 430/98, 99; 432/60; 219/216, 469

[56] References Cited

U.S. PATENT DOCUMENTS

| | | | |
|---|---|---|---|
| 2,386,583 | 10/1945 | Bacon | 29/121.8 |
| 2,843,883 | 7/1958 | Rockoff | 29/132 X |
| 3,854,975 | 12/1974 | Brenneman et al. | 117/21 |
| 4,022,122 | 5/1977 | Moser et al. | 100/158 |
| 4,104,963 | 8/1978 | Fortmann | 100/176 |
| 4,200,389 | 4/1980 | Matsui et al. | 355/3 |
| 4,235,166 | 11/1980 | Tsunoi | 100/158 |
| 4,272,179 | 6/1981 | Seanor | 430/98 X |
| 4,302,093 | 11/1981 | Landa | 29/132 X |
| 4,363,862 | 12/1982 | Giorgini | 100/176 X |

FOREIGN PATENT DOCUMENTS

| | | | |
|---|---|---|---|
| 740995 | 11/1955 | United Kingdom | 29/132 |

*Primary Examiner*—Peter Feldman

*Attorney, Agent, or Firm*—Fitzpatrick, Cella, Harper & Scinto

[57] ABSTRACT

A fixing device for use in an image formation apparatus such as an electrophotographic copying apparatus or recording apparatus, and more particularly a fixing device in which a sheet such as paper having a toner image on the surface thereof is passed between a pair of rotatable members pressed against each other to thereby fix the toner image on the sheet. In the substance forming the surface of at least one of the pair of rotatable members, particles having a hardness higher than that of said substance are dispersed to enhance the fixativeness.

22 Claims, 12 Drawing Figures

PRESSURE FIXING DEVICE

BACKGROUND OF THE INVENTION

1. Field of the Invention

This invention relates to a fixing device for use in an image formation apparatus such as an electrophotographic copying apparatus or recording apparatus, and more particularly to a fixing device in which a sheet such as paper having toner image on the surface thereof is passed between a pair of rollers pressed against each other to thereby fix the toner image on the sheet.

2. Description of the Prior Art

Description will hereinafter be made with a pressure fixing device taken as an example of the fixing device.

In the conventional pressure fixation, there have been made various propositions such as increasing the accuracy of the surfaces of rollers and applying a pressure thereto to improve the fixativeness, or making the surfaces of rollers smooth or coating the rollers with polyamide resin or providing a coating on paper to smooth the paper on which an image is to be fixed. However, in such pressure fixing devices, it has been necessary to apply a linear pressure of 20 Kg/cm or higher, or often 30 Kg/cm or higher, and effect fixation while varying the shape or thickness of paper, for example, by about −10%, under such pressure.

Generally, the surface of paper has a number of concavities. These are the interstices between the fibers of the paper. The depth of such concavities of the paper is of the order of 10μ and the distance between adjacent concavities is of the order of 20 to 50 μm.

When a toner image is transferred onto such paper, as schematically shown in FIG. 1 of the accompanying drawings, part of the toner comes into the concavities on the surface of the paper 1 and part of the toner rides onto the fibers of the paper. In FIG. 1, reference numeral 2 designates the toner which has come into the concavities of the paper 1, and reference numeral 3 denotes the toner which has ridden onto the fibers of the paper. Reference character h indicates the depth of the concavities which is about 10 μm. Also, l indicates the distance between adjacent concavities which is of the order of 20 to 50 μm.

When this paper is passed between the rollers to fix the toner image on the paper, as shown in FIG. 2 of the accompanying drawings, the surface of the paper which has originally been in a position indicated by broken line is deformed by a pressure into a shape as indicated by solid line. As seen in FIG. 2, the toner 2 which has come into the concavities of the paper has no pressure applied thereto and is not fixed.

On the other hand, the toner 3 which has been on the fibers of the paper is subjected to a pressure by the roller 5 and is thereby crushed and fixed as shown.

In order that pressure may be applied even to the toner 2 which has come into the concavities of the paper and such toner 2 may be fixed, a higher pressure becomes necessary. Generally, it is 20 Kg/cm or higher and, in order to obtain sufficient fixativeness, it must be 30 Kg/cm or higher. Also, where there is present toner 7 between toner particles 6 of a larger particle size as shown in FIG. 3, the toner 7 will have no pressure applied thereto and will remain unfixed if a sufficient pressure to dilate only the toner 6 is applied by the roller 5 as shown in FIG. 4.

To eliminate the above-described condition, the concavo-convexity of the paper must be deformed by a pressure so that such concavo-convexity is eliminated. For this purpose, it would be necessary to apply a linear pressure of at least 20 Kg/cm or higher and, in most cases, a linear pressure of 30 Kg/cm or higher. However, if such a high pressure is applied, the surface of the paper may undesirably be lustered to reduce the quality of image and the paper may be curled.

Also, as mentioned previously, there is a method of providing a coating on the paper and thereby smoothing the surface of the paper to enhance the fixativeness, whereas this is not enough to obtain sufficient fixativeness and the quality of the paper is varied by the coating and cost is increased. Further, if the paper is coated with polyamide resin, such resin which is hard will not sufficiently follow the concavities of the paper and fixation will become insufficient.

SUMMARY OF THE INVENTION

It is an object of the present invention to enable fixation to be accomplished by applying a pressure even to toner which has come into the interstices of the fibers of a sheet such as paper, without requiring a high pressure. It is also an object of the present invention to prevent lustering or curling of the sheet. It is another object of the present invention to provide a fixing device which does not require coated sheets in particular but can achieve sufficient fixativeness even if it uses conventional sheets.

The invention will become fully apparent from the following detailed description thereof taken in conjunction with the accompanying drawings.

DESCRIPTION OF THE PREFERRED EMBODIMENT

The present invention will hereinafter be described in greater detail with respect to some embodiments thereof. The following embodiments will be described with respect only to examples of the pressure fixing device, whereas it should of course be understood that the present invention is not restricted thereto but is also applicable, for example, to the so-called heating type fixing device.

Figure 1:
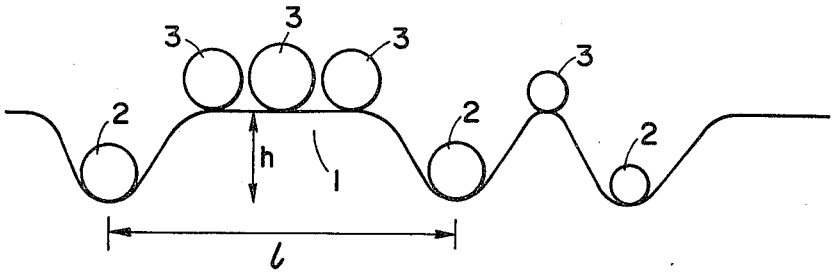
FIG. 1 PRIOR ART
FIG. 1 is a cross-sectional view showing the concavo-convexity of the surface of paper.
Figure 2:
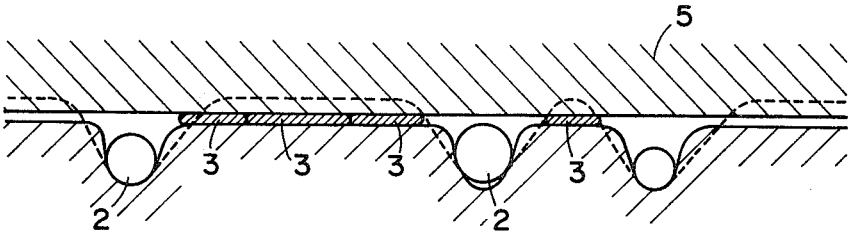
FIG. 2 PRIOR ART
FIG. 2 is a cross-sectional view schematically showing an example of the condition in which effective pressure fixation has not been achieved when pressure fixation has been effected on the surface of the paper shown in FIG. 1.
Figure 3:
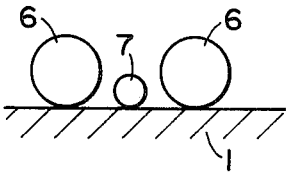
FIG. 3 PRIOR ART
FIGS. 3 and 4 are cross-sectional views schematically showing another example of the condition in which effective pressure fixation has not been accomplished.
Figure 4:
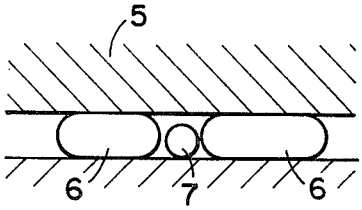
FIG. 4 PRIOR ART
Figure 5:
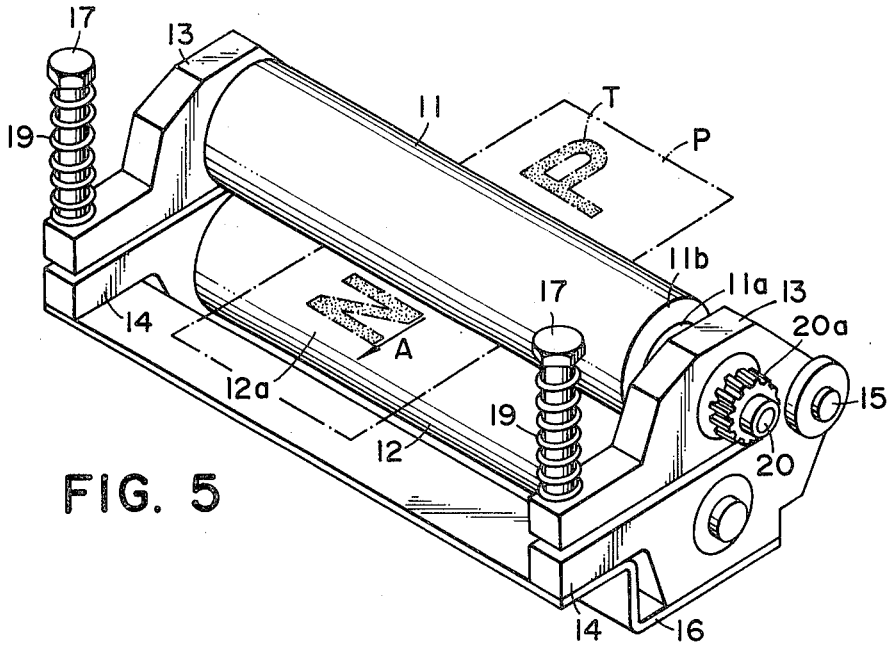
FIG. 5 is a perspective view of a pressure fixing device to which an embodiment of the present invention is applied.

FIG. 5 is a perspective view of a pressure type fixing device to which an embodiment of the present invention is applied.

In FIG. 5, reference numeral 11 designates an upper fixing roller and reference numeral 12 denotes a lower pressing roller. The upper fixing roller 11, as will hereinafter be fully described, comprises a metallic rigid member 11*a* coated with an elastic member 11*b*, within which particles having a particle size of 5–100 μm and harder than the elastic member are dispersed. The lower pressing roller is formed by a metallic rigid member 12*a*. Reference numerals 13 and 14 designate pairs of upper and lower support members to which the upper roller 11 and the lower roller 12 are journalled, and reference numeral 15 denotes a shaft coupling the upper and lower support members 13 and 14 together in such a manner that they can be opened and closed. Reference numeral 16 designates a bottom plate attached to the left and right lower support members 14 and 14. Reference numeral 17 denotes bolts loosely inserted in holes provided in the free end portions of the left and right upper support members 13 and lower support members 14 which are opposite to the opening-closing shaft 15. The bolts 17 are screwed into the lower support members 14 or inserted into the holes formed in the lower support members, and the lower ends thereof are engaged by nuts (not shown). A compression spring 19 is provided around each bolt 17 and between the head of the bolt 17 and the upper support member 13. The compression springs 19 together constitute a pressing mechanism between the rollers 11 and 12. By this pressing mechanism, a linear pressure of about 10 Kg/cm is applied to between the rollers 11 and 12. A gear 20*a* is mounted on the shaft 20 of the upper roller 11 so that a drive force is transmitted to the gear from a drive source such as a motor, not shown, to drive the upper roller 11. The lower roller 12 follows the upper roller 11.

In the present embodiment, a sheet P having on its surface a toner image T formed by a conventional image formation process is passed between the rollers 11 and 12 to thereby fix the toner image T on the sheet P.

Figure 6:
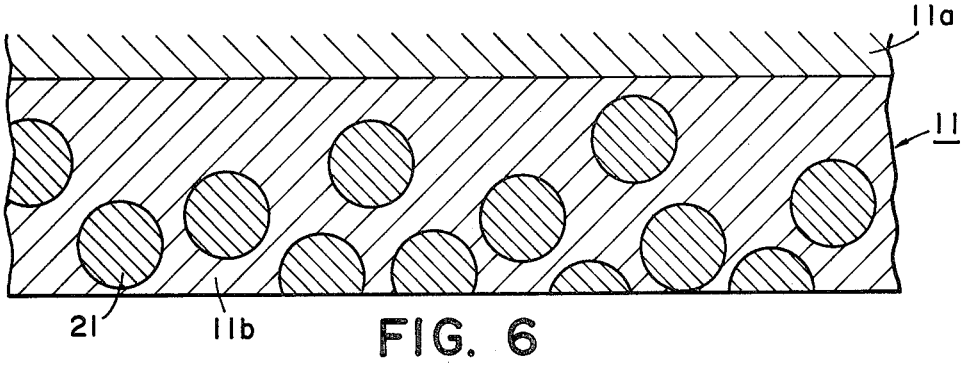
FIG. 6 is a fragmentary cross-sectional view showing an embodiment of the fixing roller according to the present invention.
Figure 7:
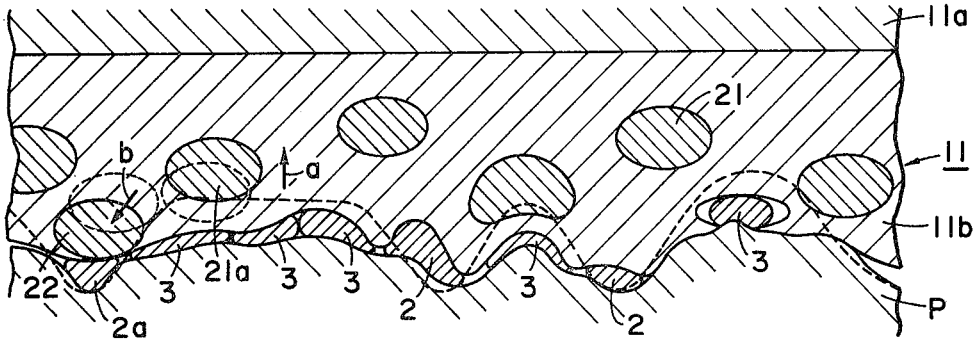
FIG. 7 is a cross-sectional view schematically showing the pressure fixation by the fixing roller shown in FIG. 6.

Reference is now had to FIGS. 6 and 7 to describe an embodiment of the present invention in greater detail.

FIG. 6 is a fragmentary cross-sectional view showing an embodiment of the upper fixing roller of the pressure fixing device according to the present invention. In FIG. 6, reference numeral 11*b* designates an elastic member having particles 21 dispersed therein, and this elastic member 11*b* covers a metallic rigid member 11*a* to form the upper fixing roller 11. The size of the particles 21 is about 5–100 μm, and the particles have a hardness higher than that of the elastic member 11*b* and may comprise either a rigid material such as a metal or an elastic material having a hardness higher than that of the elastic member 11*b*.

When the particles 21 are dispersed and hardened in the elastic member 11*b*, the particles 21 come to exist near the surface of the elastic member 11*b* as shown in FIG. 6 and the surface of the elastic member 11*b* becomes smooth.

The roller 11 of such construction is urged against the paper P shown in FIG. 5 to which the toner image T has been transferred and pressure fixation is effected. Thereupon, by a suitable pressure being applied to between the rollers 11 and 12 by the aforementioned pressing mechanism 19, the surface of the elastic member 11*b* of the roller 11 is deformed in accordance with the concavo-convexity of the paper P, as shown in FIG. 7. For example, when the particles 21*a* come onto the fibers of the paper P, the elastic member 11*b* is deformed and caves in, so that the particles 21*a* move in the direction of arrow a from their broken-line position and apply a suitable pressure to the paper in accordance with the convex portions of the fibers.

On the other hand, even if toner 2*a* having come into the interstices of the fibers of the paper is deviated a little from the interstices, the elastic member 11*b* is deformed and the particles 22 come into the interstices while being deviated from their broken-line position, as indicated by arrow b, and press the toner 2*a* and fix the same. The particles 21, 22 are harder than the elastic member 11*b* and therefore, this pressing effect is enhanced and the pressure becomes higher. Consequently, a pressure is applied to the toner 2*a* to improve the fixing effect.

In this manner, according to the present embodiment, pressure also effectively acts on the toner present in the interstices of the fibers of the paper, whereby the toner image can be fixed on the paper without giving rise to fixation irregularity.

Figure 8:
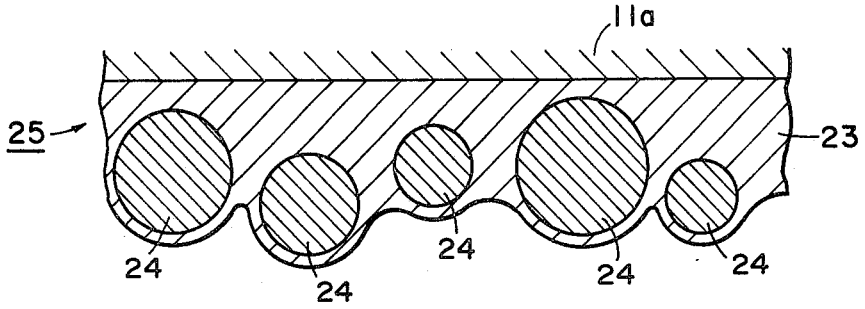
FIG. 8 is a fragmentary cross-sectional view showing another embodiment of the fixing roller according to the present invention.
Figure 9:
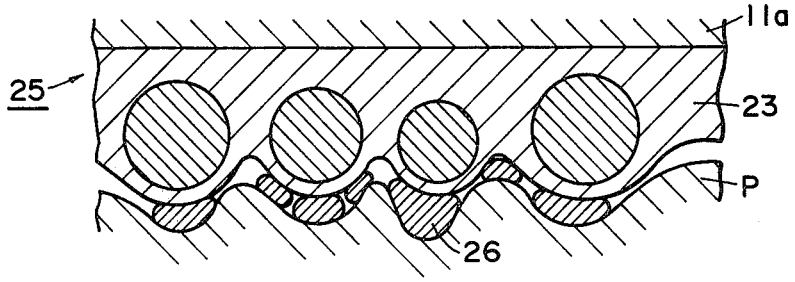
FIG. 9 is a cross-sectional view schematically showing the pressure fixation by the fixing roller showing in FIG. 8.

FIG. 8 shows another embodiment of the upper fixing roller. This roller comprises an elastic member 23 having particles 24 dispersed therein, the surface of the elastic member 23 being made concave-convex by the particles 24. FIG. 9 shows a condition in which pressure fixation has been effected by the fixing roller 25 shown in FIG. 8. In this case, the above-described fixing effect is further enhanced, that is, there is achieved a reliable fixing effect in which particles 24 projected from the elastic member 23 apply a pressure even to toner 26 present in the interstices of the fibers of the paper.

Figure 10:
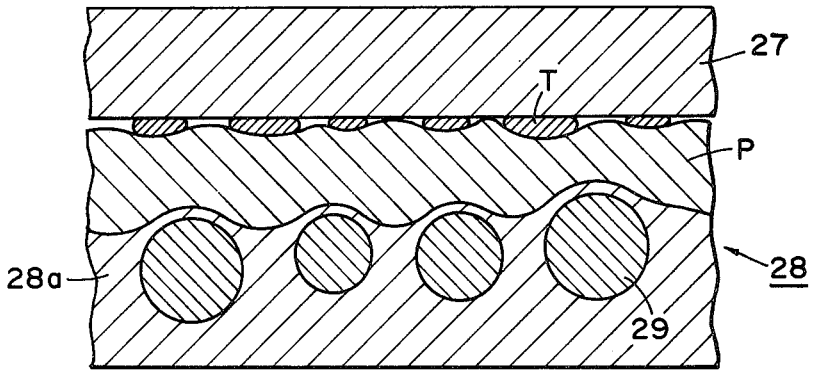
FIGS. 10 and 11 are cross-sectional views showing further embodiments.

Reference is further had to FIG. 10 to describe still another embodiment.

In this embodiment, the upper fixing roller 27 is formed by a metallic rigid member and the lower pressing roller 28 has its surface coated with an elastic member 28*a* having particles 29 dispersed therein. Again, the toner image T on the sheet P can be well fixed on the sheet P by this. Of course, the hardness of the particles 29 is higher than that of the elastic member 28*a*.

Figure 11:
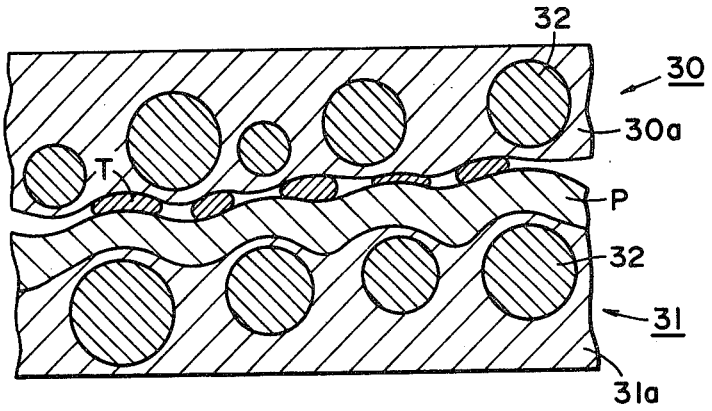

Reference is further had to FIG. 11 to describe yet still another embodiment of the present invention.

In this embodiment, both the upper fixing roller 30 and the lower pressing roller 31 have their surfaces coated with elastic members 30*a* and 31*a* having particles 32 dispersed therein, the hardness of the particles 32 being higher than that of the elastic members. According to the present embodiment, the sheet P having the toner image T thereon is pressed from above and below not only by the elastic members 30*a* and 31*a* but also by the particles having a hardness higher than that of the elastic members 30*a* and 31*a* and therefore, the fixativeness is further improved.

Now, some specific substances for (i) the elastic member and (ii) the dispersion material (particles) usable in the present invention will be enumerated below.

(i) Elastic member (1) rubber such as silicon rubber, fluorine rubber, urethane rubber, ethylene propylene rubber, styrene rubber, butyl rubber, butadiene rubber, nitrile rubber, chloroprene rubber or natural rubber.

(2) resin such as phenol resin, melamine resin, urea resin, xylene resin, ABS resin, epoxy resin, aniline resin, polyester resin, silicon resin, aryl resin, methacrylate methyl resin, acryl resin, styrene resin, ethylene resin, propylene resin, polyamide, polyimide, PPO, polysulfone, polycarbonate or polyacetal.

(ii) Dispersion material (1) From among the above-mentioned rubbers and resins, substances having a hardness higher than that of those substances used as the elastic member are suitably chosen and used.

(2) carbon black, zinc oxide, calcium carbonate, magnesium carbonate, silica or other metals or metal oxides, inorganic plastics or the like.

The above-mentioned substances can be used as the elastic member and dispersion material of the present invention.

Description will now be made of methods of making a roller comprising an elastic member haing particles dispersed therein, which roller is applicable to the present invention.

(i) Case of a rubber roller

During the kneading process in which a compound chemical is mixed with and dispersed in masticated rubber, the dispersion material is mixed to form an elastic member layer on the roller surface.

(ii) Case of a plastic roller

As in the case of the rubber roller, the dispersion material is mixed immediately before the molding.

(iii) No-field composite plating

An elastic layer is formed over the roller surface, whereafter a desired resin, together with nickel, is compositely made into entectoid in a no-field nickel plating bath.

To make the roller surface smooth as shown in FIG. 6 after the particles have been dispersed in the elastic member, the roller surface may be polished.

Next, the result of an experiment showing the relation between the particle size of the particles and the fixativeness when fixation of toner image was effected by the use of a fixing device to which an embodiment of the present invention was applied will be presented below.

This experiment was carried out under the following conditions.

(1) In the fixing device shown in FIG. 5, use was made of an upper fixing roller comprising an elastic member 11*b* formed by urethane rubber (90°) having polyimide resin dispersed therein.

(2) The linear pressure between the upper fixing roller 1 and the lower pressing roller 2 was rendered to about 10 Kg/cm by the pressing mechanism 19.

(3) The toner image T on the sheet P was formed by toner of the following composition:

| | |
|---|---|
| Toner | |
| Low molecular weight polyethylene PE 130 (Hoechst Co.) | 100 |
| Paraffin 155 | 100 |
| Magnetic material EPT-500 (Toda Kogyo Co., Ltd.) | 80 |

Figure 12:
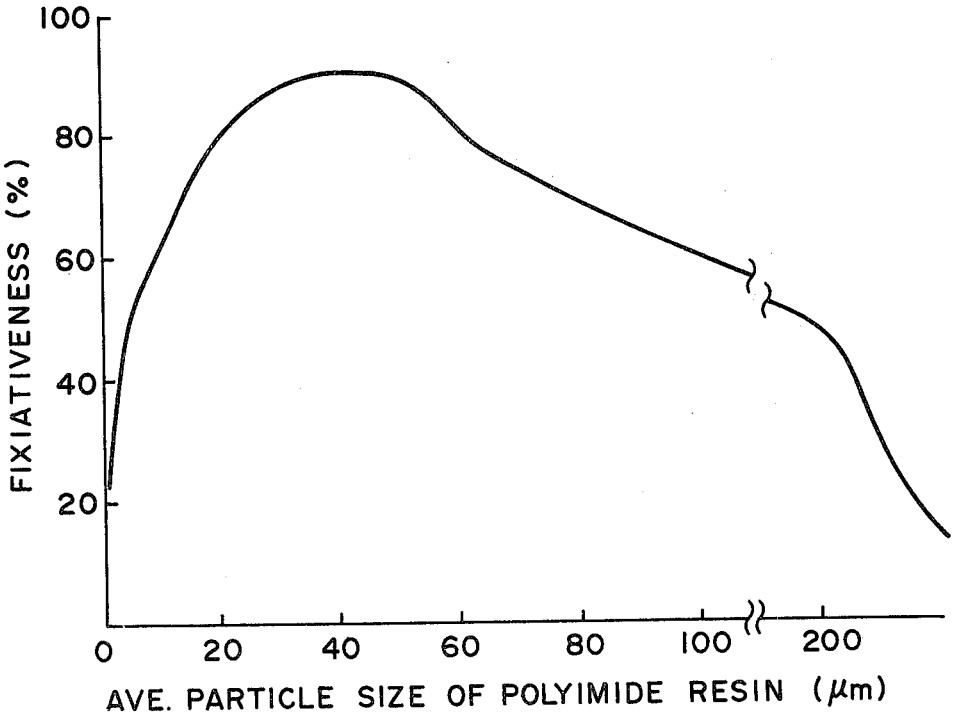
FIG. 12 is a graph illustrating the relation between the particle size of dispersion material and the fixativeness.

Now, FIG. 12 shows the relation between the particle size of the dispersion material and the fixativeness. In FIG. 12, the vertical axis represents the fixativeness and the horizontal axis represents the average particle size of polyimide resin (μm).

In the fixing device to which the present embodiment has been applied, as shown in FIG. 12, for the average particle size 5μ–200μ of polyimide resin, the fixativeness is 50% or higher which is sufficiently usable in practice, and for the average particle size 10μ–100μ, the fixativeness is further enhanced to 60% or higher. For the average particle size 20μ–60μ, fixativeness of 80% or higher is obtained. Thus, in the present embodiment, fixativeness of about 50% or higher which is practical as a fixing device can be obtained for a linear pressure of about 10 Kg/cm which is much lower than in the conventional device.

Therefore, as exemplarily shown in the previously described embodiment, the size of the particles mixed with the elastic member is preferably about 5μ–200μ, further preferably about 10μ–100μ, and most preferably about 20μ–60μ.

The term "fixativeness" used herein refers to the proportion of reflection density before and after an image fixed under the weight of 40 g/cm$^2$ is rubbed.

As described above, in the fixing device of the present invention, pressure is uniformly applied in accordance with the concavo-convexity of a sheet and particularly, pressure effectively acts on the toner present in the interstices of the fibers of the sheet, whereby fixation of images can be effectively achieved without requiring such a high pressure as will increase the deformation of the sheet and thus, fixation becomes possible at a relatively low pressure. Thus, according to the present invention which enables the fixation at a low pressure, deformation of sheets is less and lustering of the sheets can be prevented. Also, a material such as silicon rubber which has a good mold releasing property may be chosen for the elastic member and therefore, offset can be reduced.

While the foregoing embodiments have been shown with respect only to an example in which the periphery of a metallic rigid member is coated with an elastic member, the present invention is not restricted thereto but, for example, particles may be dispersed in a roller comprising an elastic member alone. The particles may consist of an elastic material having a hardness higher than that of the elastic member or may consist of a rigid material. Alternatively, particles may be provided on the surface of the elastic member and that surface may be made concavo-convex by those particles. Also, the mixture ratio of the particles and the elastic member may be suitably selected between 10% to 80% and preferably, between a volume ratio of 1:2 and a volume ratio of 2:1.

Further, the rotatable member is not restricted to a roller but may be an endless belt or the like passed over pulleys. The sheet is not restricted to paper but may be a thin sheet of plastic, metal or the like.

What we claim is:

1. A pressure fixing device comprising:

a pair of rotatable unheated members, which contact each other along a narrow band defining a nip, for pressing and transmitting a sheet bearing a toner image to fix the toner image on the sheet, at least one of said rotatable members including an elastic surface layer having particles of a hardness higher than that of said elastic layer dispersed therein so as to be present at least in the vicinity of the outer surface thereof, and when said toner image is fixed on the sheet between said rotatable unheated members, said particles deform said elastic so that the outer surface of said elastic layer follows the concave-convex surface of the sheet; and means for applying sufficient linear pressure to said pair of rotatable members so that the pressure at the nip is at least at the required peak pressure to deform the toner in order to effectively adhere the toner to the sheet by pressure alone.

2. A pressure fixing device as claimed in claim 1, wherein the material of said elastic layer is rubber such as silicon rubber, fluorine rubber or urethane rubber.

3. A pressure fixing device as claimed in claim 1, wherein the material of said elastic layer is resin such as phenol resin, melamine resin or polyimide resin.

4. A pressure fixing device as claimed in claim 1, wherein the material of said particles is rubber.

5. A pressure fixing device as claimed in claim 1, wherein the material of said particles is synthetic resin.

6. A pressure fixing device as claimed in claim 1, wherein the particle size of said particles is preferably 5μ–200μ, further preferably 10μ–100μ, and most preferably 20μ–60μ.

7. A pressure fixing device as claimed in claim 1, wherein said particles are present on the surface of said elastic layer and said surface layer is made concavo-convex by said particles.

8. A pressure fixing device as claimed in claim 1, wherein the mixture ratio of said particles and said elastic layer is between a volume ratio of 1:2 and a volume ratio of 2:1.

9. A pressure fixing device as claimed in claim 1, wherein said particles are only present within said elastic layer in the vicinity of its outer surface.

10. A pressure fixing device comprising:

a pair of rotatable unheated members, which contact each other along a narrow defining a nip, for pressing and transmitting a sheet bearing a toner image to fix the toner image on the sheet, each of said rotatable members including an elastic surface layer having particles of a hardness higher than that of said elastic layer dispersed therein so as to be present at least in the vicinity of the outer surface thereof, and when said toner image is fixed on the sheet between said rotatable unheated members, said particles deform said elastic layers so that the outer surfaces of said elastic layers follow the concave-convex surfaces of the sheet; and means for mutually pressing said pair of rotatable members together so that the pressure at the nip is at least at the required peak pressure to deform the toner in order to effectively adhere the toner to the sheet by pressure alone.

11. A pressure fixing device comprising:

a pair of rotatable unheated members which contact each other along a narrow band defining a nip, for pressing and transmitting a sheet bearing a toner image to fix the toner image on the sheet, one of said rotatable members contacting the surface of the sheet which bears the toner image and including an elastic surface layer having particles of a hardness higher than that of said elastic layer dispersed therein so as to be present at least in the vicinity of the outer surface thereof, and when said toner image is fixed on the sheet between said rotatable unheated members, said particles deform said elastic layer so that the outer surface of said elastic layer follows the concave-convex surface of the sheet; and means for mutually pressing said pair of rotatable members together so that the pressure at the nip is at least at the required peak pressure to deform the toner in order to effectively adhere the toner to the sheet by pressure alone.

12. A pressure fixing device as claimed in claim 10 or 11, wherein the material of said elastic member is rubber such as silicon rubber, fluorine rubber or urethane rubber.

13. A pressure fixing device as claimed in claim 10 or 11, wherein the material of said elastic member is resin such as phenol resin, melamine resin or polyimide resin.

14. A pressure fixing device as claimed in claim 10 or 11, wherein the material of said particles is rubber.

15. A pressure fixing device as claimed in claim 10 or 11, wherein the material of said particles is synthetic resin.

16. A pressure fixing device as claimed in claim 10 or 11, wherein the particle size of said particles is preferably 5μ–200μ, further preferably 10μ–100μ, and most preferably 20μ–60μ.

17. A pressure fixing device as claimed in claim 10 or 11, wherein said particles are present on the surface of said elastic layer and said surface of said elastic layer is made concave-convex by said particles.

18. A pressure fixing device as claimed in claim 10 or 11, wherein the mixture ratio of said particles and said elastic layer is between a volume ratio of 1:2 and a volume ratio of 2:1.

19. A pressure fixing device as claimed in claim 10 or 11, wherein said particles are only present within said elastic layer in the vicinity of its outer surface.

20. A pressure fixing device according to any of claims 1, 10, and 11, wherein the material of said particles is elastic rubber.

21. A pressure fixing device according to any of claims 1, 10, and 11, wherein the material of said particles is resin.

22. A pressure fixing device according to claim 21, wherein the material of said elastic surface layer is rubber.

* * * * *